US008777031B2

(12) United States Patent
Aneas

(10) Patent No.: US 8,777,031 B2
(45) Date of Patent: Jul. 15, 2014

(54) STOPPER DEVICE COMPRISING A SUPPORTING CAP, AND CONTAINER DEVICE PROVIDED WITH SUCH A DEVICE

(75) Inventor: Antoine Aneas, Menetrol (FR)

(73) Assignee: West Pharmaceutical Services Deutschland GmbH & Co. KG, Eschweiler (DE)

( * ) Notice: Subject to any disclaimer, the term of this patent is extended or adjusted under 35 U.S.C. 154(b) by 1008 days.

(21) Appl. No.: 12/866,100

(22) PCT Filed: Feb. 10, 2009

(86) PCT No.: PCT/FR2009/050209

§ 371 (c)(1),
(2), (4) Date: Aug. 18, 2010

(87) PCT Pub. No.: WO2009/101354

PCT Pub. Date: Aug. 20, 2009

(65) Prior Publication Data

US 2011/0000872 A1 Jan. 6, 2011

(30) Foreign Application Priority Data

Feb. 11, 2008 (FR) ..... 08 50837

(51) Int. Cl.
*B65D 41/58* (2006.01)
*B65D 39/00* (2006.01)

(52) U.S. Cl.
USPC ..... 215/249; 215/272; 215/277

(58) Field of Classification Search
USPC ..... 215/277, 355, 272, 273, 249, 293, 341
See application file for complete search history.

(56) References Cited

U.S. PATENT DOCUMENTS 4,844,267 A * 7/1989 von Schuckmann ..... 215/253
5,421,469 A * 6/1995 Lee ..... 215/274

(Continued)

FOREIGN PATENT DOCUMENTS

FR 2893922 A 6/2007
FR 2900131 A 10/2007

(Continued)

OTHER PUBLICATIONS

International Search Report PCT/FR2009/050209.

*Primary Examiner* — Mickey Yu
*Assistant Examiner* — Niki Eloshway
(74) *Attorney, Agent, or Firm* — Panitch Schwarze Belisario & Nadel LLP

(57) ABSTRACT

The invention relates to a stopper device for a container having a neck with a Δ axis. Said device comprises an elastomer stopper, a plastic cover that can cover both the neck and the stopper in place in the neck and comprises means for locking on the neck, and a cap adapted to the top of the cover by means of a central segment and provided with a peripheral supporting edge connected to the central segment by at least one connecting runout. According to the invention, the connecting runout is elastically deformable such that, under the effect of an axial effort, it enables an axial movement of the supporting edge from a raised position (R) to a lowered position, via an intermediate position (I), and, in a first deformation range corresponding to a movement of the supporting edge between the raised position (R) and the intermediate position, has a rigidity $K_1$ which is higher than the rigidity $K_2$ of the runout in a second deformation range corresponding to a displacement of the supporting edge between the intermediate position and the lowered position.

16 Claims, 4 Drawing Sheets

(56) References Cited

U.S. PATENT DOCUMENTS

| | | | | |
|---|---|---|---|---|
| 5,819,969 | A * | 10/1998 | Kalodye | 215/251 |
| 5,924,584 | A * | 7/1999 | Hellstrom et al. | 215/247 |
| 7,845,505 | B2 * | 12/2010 | Hamamoto et al. | 215/277 |
| 2001/0009243 | A1 * | 7/2001 | Browne | 215/249 |
| 2005/0199575 | A1 * | 9/2005 | Bakke Haugen et al. | 215/272 |
| 2008/0290061 | A1 * | 11/2008 | Seelhofer | 215/249 |

FOREIGN PATENT DOCUMENTS

| | | | |
|---|---|---|---|
| WO | 94/04424 | A1 | 3/1994 |
| WO | 2005/000703 | A1 | 1/2005 |

* cited by examiner

STOPPER DEVICE COMPRISING A SUPPORTING CAP, AND CONTAINER DEVICE PROVIDED WITH SUCH A DEVICE

The invention relates to a stopper device for stopping a container provided with a neck, and it also relates to a container equipped with such a device.

In the field of containers for medication, it is known that a glass bottle can be used to store an active ingredient in freeze-dried form, in powder form, or in the form of a liquid solution. Such a bottle must be closed off in leaktight manner so as to maintain its content in a satisfactory state of preservation, until the date on which it is used. In order to close a bottle hermetically, it is known that a stopper device can be used that comprises an elastomer stopper that has the function of being totally sealed against gas, liquids, and bacteria. Such a device further comprises a locking cover that, as mentioned in FR 2 900 131, U.S. Pat. No. 5,678,719 or U.S. Pat. No. 5,421,469, can be made of a plastics material, and that is designed to be held in place around the stopper so as to isolate it from the outside and so as to oppose removal of it.

When using such a stopper device for freeze-dried pharmaceutical substances, for example, each container is filled with a quantity of substance for freeze-drying, and then the respective stopper is placed on or in the neck of the container in such a manner as to be secured thereto while also preserving communication between the outside environment and the inside of the container. Containers filled and pre-stopped in this way are then placed in batches on the shelves of a freeze drier inside which the substances are dehydrated. During freeze-drying of the content of a container, vacuum cold-drying is performed that guarantees that the water is extracted from the substance by sublimation and evaporation.

Once the substances have been dehydrated, pressure is applied inside the freeze drier to all of the stoppers of the containers in such a manner as to ensure that the containers are stopped hermetically by each stopper being engaged on or in the neck of the corresponding container. Such stopping in batches is generally performed with the elastomer stopper alone, without the locking cover. Thus, further work needs to be done on each of the containers on exiting from the freeze drier for the purpose of putting the locking cover in place on it. Therefore, in order to avoid such an additional operation, it has been envisaged to place the corresponding locking cover on each of the stoppers of the pre-stopped containers before freeze drying so that the locking covers are also put in place while the stoppers are being pressed into place inside the freeze drier. However, that operation has not been fully satisfactory with prior art stopper devices.

Actually, when the cover needs to be moved so as to be locked around the neck of the corresponding container, friction occurs, the magnitude of which varies as a function firstly of the manufacturing tolerances of the component parts of the cover, and secondly of the pre-positioning of said parts when they are installed on the neck of the container. Thus, when a presser plate is used inside the freeze drier to lock the covers of a large number of containers, it can happen that, in view of the manufacturing tolerances of the component parts of the covers and in view of the operating clearances of the presser plate, certain covers are not locked correctly. Similarly, the dimensional variations in the containers themselves, and in the stoppers that are used have a negative influence on closure of a batch of containers. In view of those difficulties, until now, it has been decided not to put the stoppers and the locking covers in place simultaneously on batches of containers inside a freeze drier, and it is therefore necessary to put the cover in place subsequently and thus to perform complex and costly operations when packaging freeze-dried substances.

A object of the invention is, more particularly, to remedy those drawbacks by proposing a stopper device by means of which a force for locking a cover can be transmitted effectively, even when account is taken of the manufacturing tolerances of the bottles, of the stoppers, of the component parts of a cover, and of the mechanical members for applying the force.

To this end, the invention relates to a stopper device for stopping a container having a neck of axis Δ, said device comprising:

- an elastomer stopper;
- a cover made of a plastics material that is suitable for covering both the neck and the stopper in place in the neck, and that is provided with locking means for locking it to the neck; and
- a cap that fits over the top of the cover by means of a central stud and that is provided with a peripheral press rim connected to the central stud via at least one connecting web.

According to the invention, the stopper device is characterized in that firstly the connecting web is elastically deformable in a manner such that, under the effect of an axial force, it enables the press rim to be moved axially from a raised position R towards a lowered position A via an intermediate position I, and secondly, over a first deformation range, corresponding to the press rim being moved from the raised position R to the intermediate position I, said connecting web has a stiffness $K_1$ greater than the stiffness $K_2$ of the web over a second deformation range corresponding to the press rim being moved from the intermediate position I to the lowered position A.

Using such a connecting web offers the advantage of making it possible, once the stopper and the cover have been fully engaged and locked, for the press rim to collapse so that it no longer exerts any more than a small amount of stress or reaction on the presser plate, the action of that plate then being transferred to the press rims of the stopper devices that are not yet locked. This transfer thus makes it possible to increase the force available on the stopper devices that are not yet engaged and thus to compensate for the variations due to dimensional and structural dispersions. Thus, the invention also makes it possible to increase significantly the number of containers that are properly stopped when they exit from the freeze drier.

According to a characteristic of the invention, the connecting web is adapted so that, while the press rim is moving from the raised position, said press rim exerts an increasing reaction that decreases after it has reached a maximum value at the intermediate position.

According to another characteristic of the invention, the value of the axial pressure to be applied to the press rim of the cap in order to cause it to go from its raised position to its intermediate position is greater than the force necessary for engaging the stopper into the neck of the container with the cover being locked to the neck. Such a value for the stiffness of the connecting web makes it possible to guarantee that the press rim is lowered only once the stopper is properly engaged and once the cover is locked to the neck of the container.

According to yet another characteristic of the invention, only the raised position of the press rim is a stable position so that, in the event that the axial force ceases to be applied, the press rim returns automatically to its raised position.

In accordance with the invention, the locking means of the cover may be implemented in various manners and, for example, comprise locking fingers that are integral with the cover. However, in accordance with the invention, such an embodiment is not necessary and the locking means may be separate and mounted on or in the cover.

Thus, in an embodiment, the locking means comprise a ring that is placed at least in part inside the cover and that has an annular ceiling and a peripheral band that is integral with the annular ceiling and from which there extend at least two elastically deformable tongues that, opposite from the band, have respective locking ends designed to engage under the neck of the container. Using such a locking ring makes it possible to facilitate manufacture of the cover, while imparting a good external appearance to it. In addition, in certain configurations, this embodiment makes it possible to dissociate clearly the stage of pushing in the stopper from the stage of locking the cover to the neck of the container, thereby avoiding cumulative stresses resulting from pushing in the stopper and from locking the cover.

In a first variant embodiment, each tongue extends away from the annular ceiling in a direction that is substantially axial, its locking end being curved over inwards to define a catch designed to come into abutment under the neck of the container.

According to a characteristic of this first variant each tongue has a distal portion that extends outwards and, on the outside face of said distal portion, each tongue has a blocking lug that is designed to co-operate with a complementary blocking recess in the cover.

According to another characteristics of this first variant, the inside face of the distal portion of each tongue is shaped to come into abutment against the neck of the container in the locking position.

According to yet another characteristic of this first variant, the bottom end of each tongue that forms its catch is reinforced.

According to another characteristic of this first variant, at least one of the tongues has, on the outside face of a proximal portion, an assembly rib designed to co-operate with the blocking recess to couple the ring to the cover before the cover is engaged fully over the ring.

In a second variant of said embodiment, each tongue extends towards the annular ceiling from the peripheral rim while extending towards the inside of the ring.

According to a characteristic of this second variant embodiment, the cover has a skirt that, at an end opposite from the cap, is provided with blocking means for blocking movement of the tongues when the cover is fully engaged over the ring.

According to another characteristic of the second variant, the ring has an outer annular belt designed to surround the skirt of the cover when the cover is fully engaged over the ring.

According to yet another characteristic of the second variant, the cover is provided with locking means designed to co-operate with complementary locking means of the annular belt when the cover is fully engaged over the ring in such a manner as to oppose removal of the cover.

The invention also relates to a container equipped with a stopper device of the invention.

Naturally, the various forms, variants, and characteristics of the invention may be combined with one another in various combinations insofar as they are not mutually incompatible or mutually exclusive.

In addition, various other characteristics of the invention appear from the following description given with reference to the drawings that show non-limiting embodiments of a stopper device of the invention, and in which:

In FIG. 4, the cap is in a raised position, while in FIG. 5, it is in an intermediate position, and in FIG. 6 it is in a lowered position;

Figure 7:
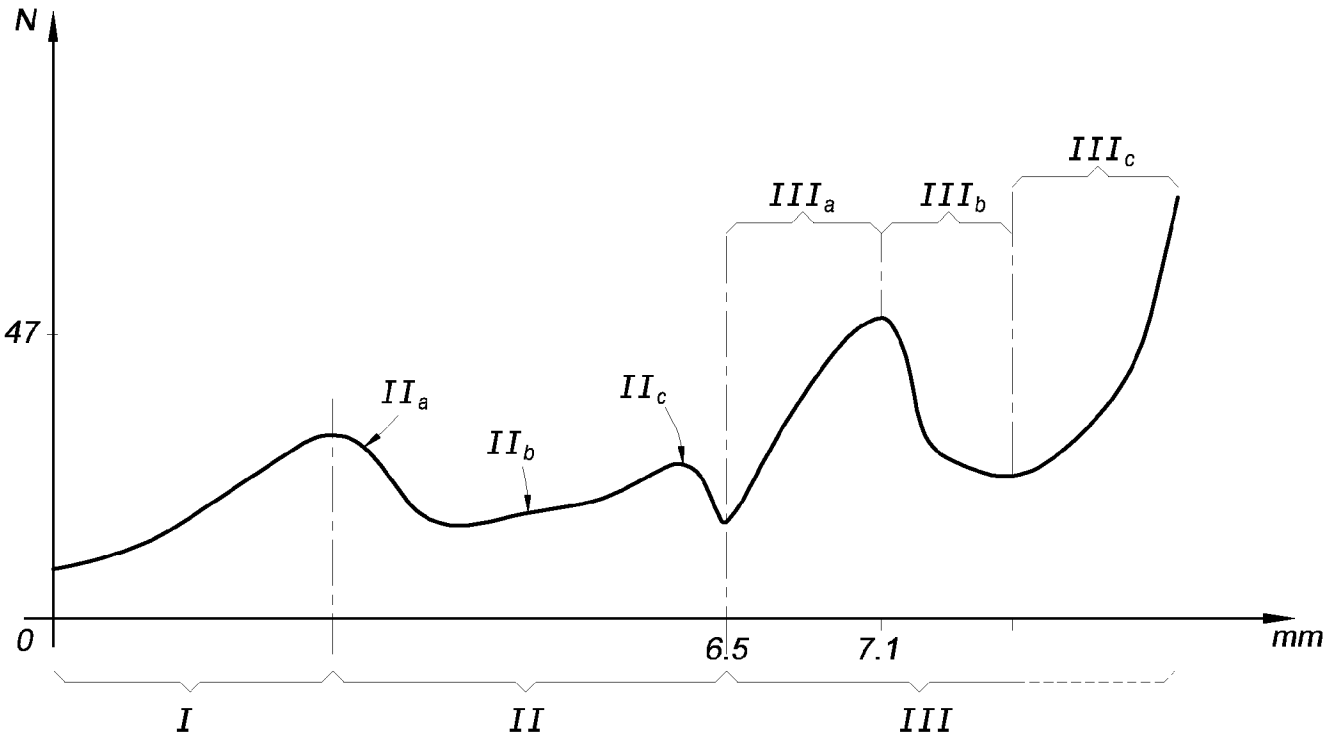
Figure 8:
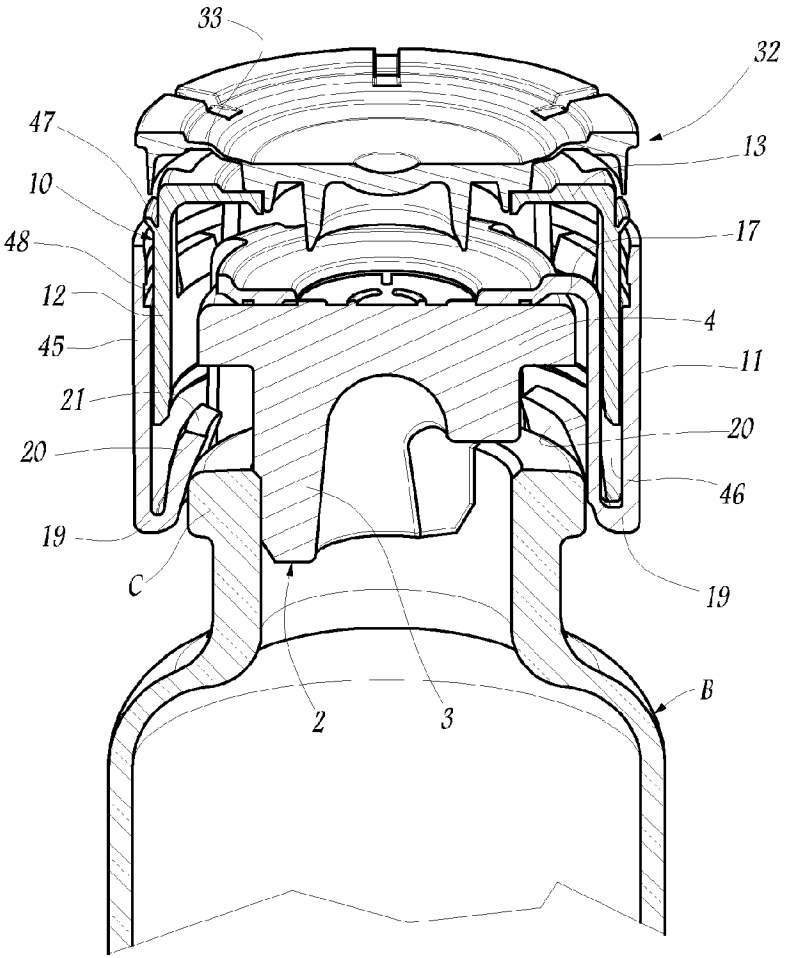

FIG. 7 is a graph showing the value of the axial force exerted on or by the press rim during pushing-in of the stopper followed by locking of the cover, with, along the abscissa axis, the movement of the press rim expressed in millimeters, and, up the ordinate axis, the absolute value of the axial force expressed in newtons; and FIG. 8 is a partially cutaway perspective view of a variant embodiment of the stopper device of the invention.

Figure 1:
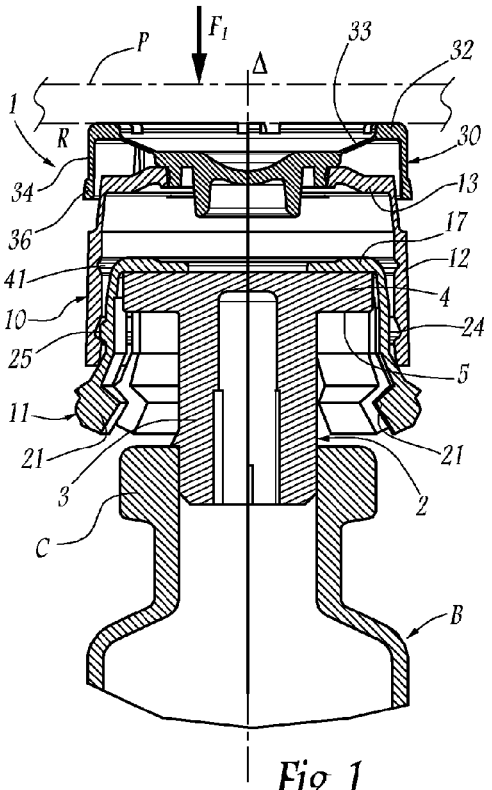
FIG. 1 is an axial section view of a stopper device of the invention, pre-positioned on the neck of a container before the stopper has been pushed in fully, and before the cover has been locked, the cap being in a raised position.

A stopper device of the invention, shown in FIG. 1 and designated by overall reference 1, is designed to close the neck C of a container B in leaktight and secure manner. To this end, the stopper device 1 includes an elastomer stopper 2 designed to be engaged in the neck C of the container. The stopper 2 is T-shaped in general shape, and has a tubular body 3 designed to be engaged into the neck 2. The body 3 then underlies a head 4 that defines a peripheral flange 5 for abutting against the top edge of the neck C.

Figure 5:
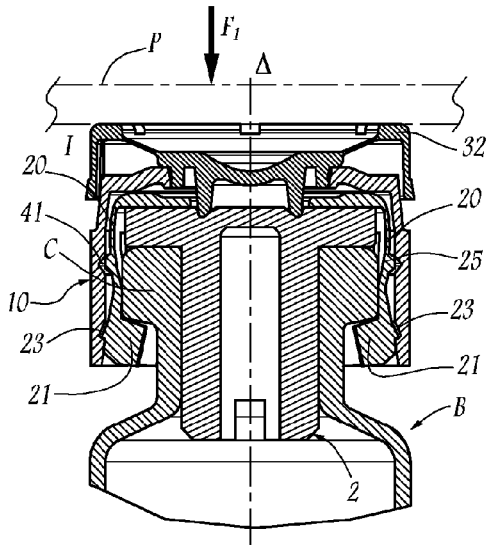
Figure 6:
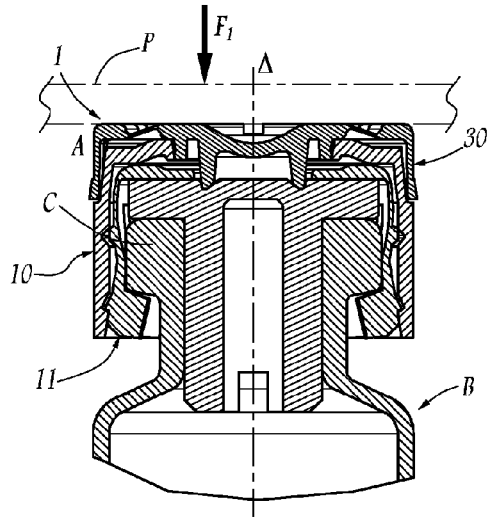

The stopper device also includes a cover made of a plastics material 10 that is suitable for covering both the neck C and the stopper 2 in place in the neck C as shown in FIGS. 5 and 6. In order to prevent the stopper 2 from being removed in untimely manner, the cover 10 is provided with locking means 11 for locking it to the neck. In the example shown, the cover 10 has a peripheral skirt 12 that is substantially cylindrical in general shape and of axis Δ. The cover 10 also has a top 13 that is integral with the skirt 12 and that is provided with a through axial bore 14.

Figure 2:
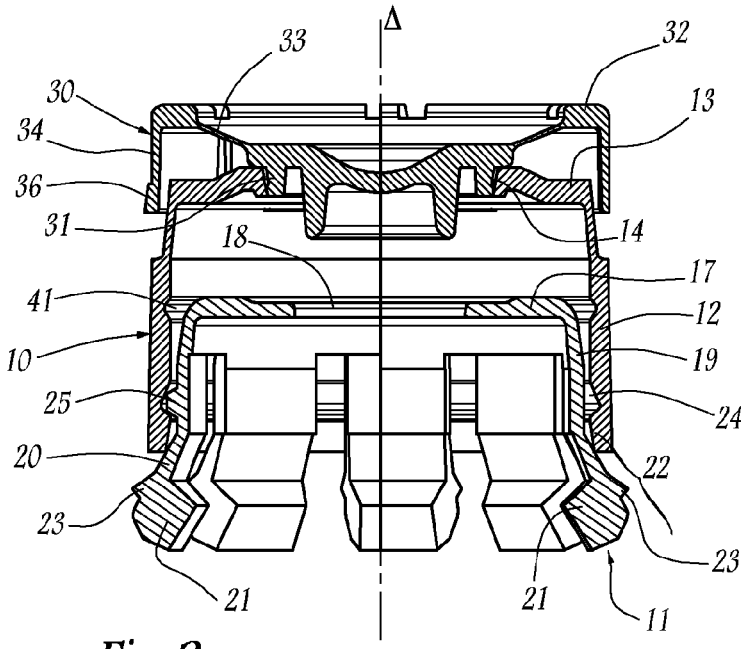
FIG. 2 is an axial section view of the cover of the stopper device shown in FIG. 1.
Figure 3:
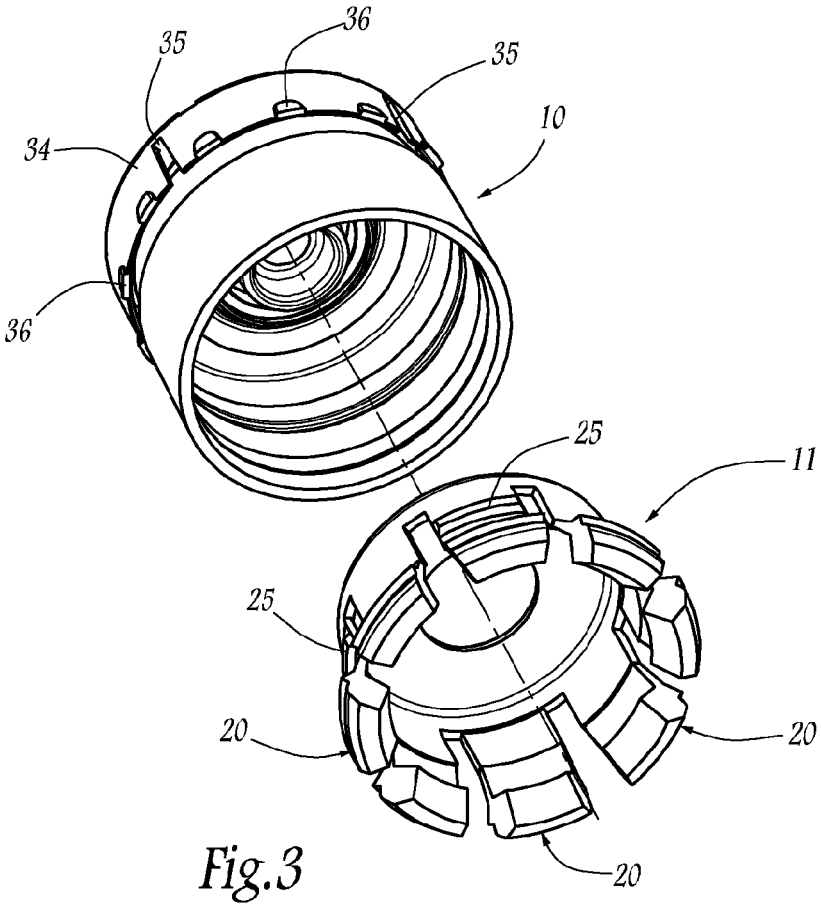
FIG. 3 is an exploded perspective view of the cap shown in FIG. 1.

In the example shown, the locking means 11 for locking the cover 10 are in the form of a ring 11 that is designed to be placed at least in part inside the cover 10. As appears, in particular in FIGS. 1 and 2, the ring 11 has an annular ceiling 17 provided with a through axial opening 18 situated in register with the axial bore 14 in the cover 10, when the ring 11 is engaged inside said cover. The ceiling 17 is edged by a downwardly extending peripheral band 19 from which at least two, and, in the example shown, eight, elastically deformable tongues 20 extend. In the present example, each tongue 20 extends from the band 19 in a substantially axial direction away from the ceiling 17. The free end of each tongue 19 is curved over towards the inside of the ring 11 so as to define a catch 21 designed to engage under the neck C of the container R as appears below. In the example shown, the catch 21 of each tongue is thicker or reinforced relative to the remainder of the tongue in such a manner as to present good resistance to being pulled off. In addition, a distal portion 22 of each tongue extends outwards and has, on its outside face, a blocking lug 23 designed to co-operate with a complementary blocking recess 24 in the cover 10 when said cover is fully engaged over the locking ring. In the example shown, the complementary recess 24 is in the form of an annular groove provided inside the skirt 12 of the cover 10 and in the vicinity of a bottom end thereof. Finally, at least one and, in the example shown, four, tongues are provided with respective assembly ribs 25 on the outside faces of respective proximal portions of the tongues, which ribs are designed to cooperate with the blocking recess (the groove 24 in this example) to couple the ring 11 to cover 10 before the cover 10 is fully engaged over the ring 11, as shown more particularly in FIGS. 1 and 2. It can be observed that, in FIG. 3, only two of the four assembly ribs 25 are visible, while, in FIGS. 1, 2, and 4 to 6, only one of the assembly ribs 25 is visible.

The stopper device 1 of the invention also includes a cap 30 that has a central or axial stud 31 engaged in the axial bore 14 in such a manner as to couple the cap 30 to the cover 10. Thus, the cap 30 closes off the axial bore 14 and, before it is removed, opposes any access to the stopper 2 via the bore 14 and via the opening 18. The cap 30 also has a peripheral press rim 32 that is connected to the stud 31 via at least one, and, in the example shown, exactly one, connecting web 33 that is elastically deformable in such a manner as to enable the press rim 32 to move axially under drive from an axial force. Thus, the press rim is mounted to move between a raised position R shown in FIG. 1, and a lowered position A, shown in FIG. 6. In addition, the web 33 is adapted so that the raised position R is a stable position whereas the other positions are unstable positions. By means of this characteristic, the press rim automatically returns to the raised position R when stress ceases to be applied to it.

The stopper device 1, as constituted in this way, is used in the following manner.

Once the container has been filled, with a substance that is, for example, to be freeze-dried, the stopper 2 is engaged in part in the neck of the container B as shown in FIG. 1, and the assembly formed by the locking ring 11, by the cover 10, and by the cap 30 is positioned over the stopper 2, the ceiling 17 of the ring 11 coming into abutment against the head 4 of the stopper 2. The container B equipped in this way is then placed inside a freeze drier (not shown) with other identical containers that are identically equipped, for the purposes of having their contents dehydrated in said freeze drier. It should be noted that, for this purpose, the stopper device 1 is designed in such a manner that, in its semi-engaged position, as shown in FIG. 1, it enables the outside environment to communicate with the inside of the container, so as to allow the vapor generated during dehydration to be removed. Once dehydration has been performed, the set of containers equipped with the stopper devices 1 of the invention and disposed inside the freeze drier can be stopped in final manner.

Figure 4:
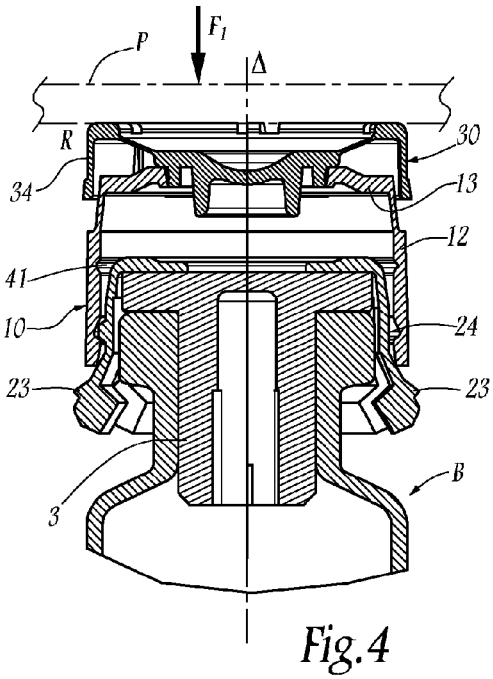
FIGS. 4 to 6 are axial section views analogous to FIG. 1, showing successive steps in putting the stopper device in place.

For this purpose, pressure is applied on the press rim 32 in the direction indicated by arrow $F_1$ by means of a presser plate P shown diagrammatically in chain-dotted lines in FIGS. 1 and 4 to 6. In a first stage, this pressure $F_1$ causes the stopper to be pushed fully into the neck of the container until the head 4 is brought into abutment against said neck C, as is shown in FIG. 4. It should be noted that, in the example shown, the curved-over ends 21 of the tongues 20 are far enough apart not to interfere with the neck of the container B, or not to interfere very much therewith, in such a manner as not to increase the stresses necessary to push in the stopper 4.

FIG. 7 shows the value of the force exerted on or by the press rim 32 of the stopper device 1 as a function of the movement of said press rim 32. Thus, the push-in stage as described above corresponds substantially to the first portion I of the curve.

Once the stopper 2 has been pushed in, the force on the press rim 32 is maintained, as shown in the second portion II of the curve, in such a manner as to guarantee that the cover 10 is engaged over the locking ring 11. Firstly, the assembly ribs 25 disengage from the annular groove 24, zone IIa of the curve, then the locking ends 21 of the tongues 20 move inwards under the neck C as shown in FIG. 5, corresponding to zone IIb of the curve. The cover 10 continues to be pushed until the blocking lugs 23 are brought into the groove 24 as shown in FIG. 5, corresponding to zone IIc of the curve. At this stage, the stopper device 1 of the invention is securely locked to the container B so that it closes the container in securely leaktight manner. However, in view of the dimensional and structural dispersions, it is not possible to be certain that all of the stopper devices of all of the containers of the batch placed in the freeze drier are also closed. It is therefore necessary to continue to exert a force and to continue to move the presser plate P as appears in portion III of the curve. In the configuration of the container shown in FIG. 5, the stress exerted on the presser plate is transferred mainly to the web 33 insofar as there exists continuity of abutment between the neck C and top 13. In view of the resilience of the web 33, the force that is exerted causes the press rim 32 to move from the raised position R towards an intermediate position I. In addition, in view of the design of the web 33, during the movement, said web exerts a large amount of resistance to collapsing of the press rim 32, as shown by portion IIIa of the curve. Then, once the press rim 32 has gone beyond the intermediate position I, the resistance from the web 33 and thus the reaction from the press rim 32 decreases substantially (portion IIIb of the curve), so that the force available at the presser plate is transferred automatically to the adjacent stopper devices that are not necessarily fully locked yet. In order to guarantee that stopping takes place in such a sequential manner, the web 33 is designed in such a manner that the force necessary for bringing the press rim 32 from the raised position R to the intermediate position I is greater than the force that it is necessary to exert to push in the stopper 2 fully, with the ring 11 and the cover 10 also being locked.

Thus, during the stopping stages corresponding to portions I and II of the curve of FIG. 7, the press rim 32 is in the raised position R, in the stage corresponding to portion IIIa of the curve, the press rim 32 goes from the raised position R to the intermediate position I, and then in the stage corresponding to portion IIIb of the curve, the press rim 32 moves from the intermediate position I to the lowered position A. The last portion IIIc of the curve corresponds to when the force continues to be exerted on the press rim 32, the movement of the plate corresponding to elastic compression of the press rim 32 and of the various component parts of the stopper device 1.

When the force ceases to be exerted on the press rim 32, and the presser plate is removed, the press rim 32 spontaneously returns to its raised position R under the effect of the resilience of the web 33. In order to avoid a suction cup effect that would prevent the press rim 32 and the connecting web 33 from returning to their original configuration, the peripheral band 34 of the cap 30 has at least one and, in the example shown, four, vents 35, two of which are visible in FIG. 3.

In addition, the peripheral band 34 is provided with a series of spikes or pieces of roughness 36 distributed around its periphery in order to facilitate taking hold of the cap 30 for pulling it off in order to make it possible to draw off the content of the container B, e.g. by using a syringe having its needle plunged through the head 4 of the stopper 2.

In the example shown, in order to avoid any conflict between the skirt 10 and the assembly ribs 25 in the locking position as shown in FIG. 5, the skirt 10 is provided with an intermediate groove 41 into which the assembly ribs 25 come to be positioned once the cover 10 is fully engaged over the locking ring 11, as shown in FIG. 5.

In addition, it can be noted that, in the example shown, the inside face of the distal portion 22 of each tongue 20 is, in the locked position, substantially in abutment against the neck C of the container B, while the outside face of each tongue presents, in axial section, a generally V-shaped configuration. Such an arrangement causes each tongue 20 to brace itself against any pull-off stress that is exerted on the cover 10 or on the catches 21 of the tongues 20, given that the stopper device of the invention is also locked to the neck C of the container B.

Naturally, in accordance with the invention, the cover 10 and the associated locking means may be made in a manner entirely different from the manner described above with reference to FIGS. 1 to 6.

Thus, FIG. 8 shows another embodiment of a stopper device 1 in which the tongues 20 extend upwards towards the annular ceiling 13 from the peripheral band 19. The ring 11 further includes an outer annular belt 45 that co-operates with the band 19 to define an annular recess 46 into which the skirt 12 of the cover 10 is engaged. In addition, the bottom end of the skirt 12 that is opposite from the cap 30 has a shape that defines blocking means for blocking movement of the tongues 20 when the cover is fully engaged over the ring 10. Finally, the skirt 12 of the cover 10 is provided with locking means in the form of a peripheral lip 47 designed to co-operate with complementary locking means with which the belt 46 is provided, which locking means are, in this example, constituted by an annular groove 48. The locking means 47 and 48 prevent any untimely removal of the cover 10 once said cover has been engaged over the locking ring 11.

In addition, in the above-described examples, the press rim 32 and the connecting web 33 are monostable, the press rim returning automatically to the raised position R when no stress is applied to it. However, in accordance with the invention, the connecting web 33 may be designed so that the press rim 32 is bistable. In which case, when the press rim goes beyond the intermediate position I, it goes spontaneously into the lowered position A. Thus, only the raised position R and the lowered position A of the press rim 32 are stable positions.

Naturally, various other modifications may be made to the invention within the ambit defined by the claims.

The invention claimed is:

1. A stopper device for stopping a container having a neck of axis Δ, said device comprising:

an elastomeric stopper;

a cover made of a plastics material that is suitable for covering both the neck and the stopper in place in the neck, and that is provided with locking means for locking the cover to the neck; and a cap that fits over the top of the cover by means of a central stud and that is provided with a peripheral press rim connected to the central stud via at least one elastically deformable connecting web thereby enabling axial movement of the press rim from a raised position towards a lowered position via an intermediate position upon application of an axial force thereto, wherein the connecting web defines a stiffness K1 over a first deformation range corresponding to movement of the press rim from the raised position to the intermediate position, and the connecting web defines a stiffness K2 over a second deformation range corresponding to movement of the press rim from the intermediate position to the lowered position, and wherein the stiffness K1 is greater than the stiffness K2.

2. A device according to claim 1, wherein the connecting web is adapted so that, while the press rim is moving from the raised position, said press rim exerts an increasing reaction that decreases after it has reached a maximum value at the intermediate position.

3. A device according to claim 1, wherein the value of the axial force to be applied to the press rim of the cap in order to cause it to go from its raised position to its intermediate position is greater than the force necessary for engaging the stopper into the neck of the container with the cover being locked to the neck.

4. A device according to claim 1, wherein only the raised position of the press rim is a stable position so that, in the event that the axial force ceases to be applied, the press rim returns automatically to its raised position.

5. A device according to claim 1, wherein only the raised position and the lowered position are stable positions.

6. A device according to claim 1, wherein the locking means comprise a ring that is placed at least in part inside the cover and that has an annular ceiling and a peripheral band that is integral with the annular ceiling and from which there extend at least two elastically deformable tongues that, opposite from the band, have respective locking ends designed to engage under the neck of the container.

7. A device according to claim 6, wherein each tongue extends away from the annular ceiling in a direction that is substantially axial, its locking end being curved over inwards to define a catch designed to come into abutment under the neck of the container.

8. A device according to claim 7, wherein each tongue has a distal portion that extends outwards and, on the outside face of said distal portion, each tongue has a blocking lug that is designed to co-operate with a complementary blocking recess in the cover.

9. A device according to claim 8, wherein the inside face of the distal portion of each tongue is shaped to come into abutment against the neck of the container in the locking position.

10. A device according to claim 8, wherein at least one of the tongues has, on the outside face of a proximal portion, an assembly rib designed to co-operate with the blocking recess to couple the ring to the cover before the cover is engaged fully over the ring.

11. A device according to claim 7, wherein the bottom end of each tongue that forms its catch is reinforced.

12. A device according to claim 6, wherein each tongue extends towards the annular ceiling from the peripheral rim while extending towards the inside of the ring.

13. A device according to claim 12, wherein the cover has a skirt that, at an end opposite from the cap, is provided with blocking means for blocking movement of the tongues when the cover is fully engaged over the ring.

14. A device according to claim 13, wherein the ring has an outer annular belt designed to surround the skirt of the cover when the cover is fully engaged over the ring.

15. A device according to claim 14, wherein the cover is provided with locking means designed to co-operate with complementary locking means of the annular belt when the cover is fully engaged over the ring in such a manner as to oppose removal of the cover.

16. A container equipped with a stopper device according to claim 1.

* * * * *